US007225764B2

(12) United States Patent
Odeskog et al.

(10) Patent No.: US 7,225,764 B2
(45) Date of Patent: Jun. 5, 2007

(54) METHOD FOR OPERATING A COMBUSTION ENGINE

(75) Inventors: Jim Odeskog, Stuttgart (DE); Holger Huelser, Graz (AT); Frank Bickendorf, Ditzingen (DE); Thorsten Juenemann, Sindelfingen (DE); Isabelle Gentil-Kreienkamp, Bietigheim-Bissingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/504,724

(22) PCT Filed: Dec. 20, 2002

(86) PCT No.: PCT/DE02/04672

§ 371 (c)(1),
(2), (4) Date: May 9, 2005

(87) PCT Pub. No.: WO03/069141

PCT Pub. Date: Aug. 21, 2003

(65) Prior Publication Data

US 2005/0228571 A1 Oct. 13, 2005

(30) Foreign Application Priority Data

Feb. 15, 2002 (DE) ..... 102 06 297

(51) Int. Cl.
*F01P 9/00* (2006.01)

(52) U.S. Cl. ..... 123/41.01; 123/568.16

(58) Field of Classification Search ..... 123/41.01, 123/41.08, 41.09, 41.1, 41.02, 568.21, 568.16
See application file for complete search history.

(56) References Cited

U.S. PATENT DOCUMENTS 6,904,875 B2 * 6/2005 Kilger ..... 123/41.1
7,013,848 B2 * 3/2006 Gentil-Kreienkamp et al. .. 123/41.1

FOREIGN PATENT DOCUMENTS

| | | |
|---|---|---|
| DE | 30 24 209 | 1/1981 |
| DE | 38 10 174 | 10/1989 |
| DE | 41 09 498 | 9/1992 |
| DE | 199 51 362 | 5/2001 |
| EP | 0 497 034 | 8/1992 |
| EP | 0 497 034 | 5/1994 |
| WO | WO 01/12964 | 2/2001 |

* cited by examiner

*Primary Examiner*—Stephen K. Cronin
*Assistant Examiner*—Katrina Harris
(74) *Attorney, Agent, or Firm*—Kenyon & Kenyon LLP

(57) ABSTRACT

A method for operating an internal combustion engine is provided. By taking into account a setpoint temperature $T_{setpoint}$ of the internal combustion engine which depends on external and internal boundary conditions when controlling and/or regulating temperature-dependent functions of the internal combustion engine, fuel consumption and emission characteristics of the internal combustion engine are improved.

5 Claims, 2 Drawing Sheets

METHOD FOR OPERATING A COMBUSTION ENGINE

FIELD OF THE INVENTION

The present invention relates to a method for operating an internal combustion engine whereby the efficiency and emission characteristics are improved.

BACKGROUND INFORMATION

German Published Patent Document No. 30 24 209 and German Published Patent Document No. 41 09 498 discuss a method for the liquid-cooling of internal combustion engines in which the setpoint value of the coolant temperature is varied as a function of different parameters such as outside temperature, operating state of the engine, etc. This makes it possible to quickly attain the operating temperature after startup of the engine, while preventing the engine from overheating in all operating states. However, changing the setpoint value of the engine temperature also affects the operating performance of the engine, making it necessary to perform additional optimization.

SUMMARY OF THE INVENTION

In a method according to the present invention for controlling an internal combustion engine, boundary conditions for operating the engine are determined, a setpoint value of the engine temperature is determined as a function of the boundary conditions for operating the internal combustion engine, and the temperature-dependent functions of the internal combustion engine are controlled and/or regulated as a function of the setpoint value of the internal combustion engine temperature setpoint $T_{setpoint}$ in such a manner as to make it possible to take the specified variable internal combustion engine temperature setpoint value into account even when controlling or regulating other temperature-dependent internal combustion engine functions.

This combination according to the present invention of determining the boundary conditions for internal combustion engine operation, determining an internal combustion engine temperature setpoint value, and controlling and/or regulating the temperature-dependent functions of the internal combustion engine makes it possible to further enhance the efficiency of the internal combustion engine, while reducing emissions. In addition, the service life and load-bearing capacity of the internal combustion engine are increased by the method according to the present invention because the internal combustion engine is always operated in a narrow temperature range.

In a further exemplary embodiment of the method according to the present invention, the ambient temperature, the air humidity, the load on and speed of the internal combustion engine and/or the composition of the fuel/air mixture of the internal combustion engine are determined as the boundary condition for operating the internal combustion engine. Using the above boundary conditions, which are listed as examples only, an internal combustion engine temperature setpoint value may be determined, which makes it possible to operate the internal combustion engine with optimum efficiency and emission characteristics.

In a further exemplary embodiment of the method according to the present invention the exhaust gas recycling rate, the injection amount, the injection point, the ignition point, the thermostat valve of the cooling circuit and/or the activation of the coolant pump is/are controlled and/or regulated as a function of the internal combustion engine temperature setpoint value. The internal combustion engine temperature affects the above-named functions in such a manner that by variably specifying an internal combustion engine temperature setpoint value and taking it into account in the above-listed exemplary functions, it is possible to optimize the operating performance as desired.

DETAILED DESCRIPTION

Figure 1:
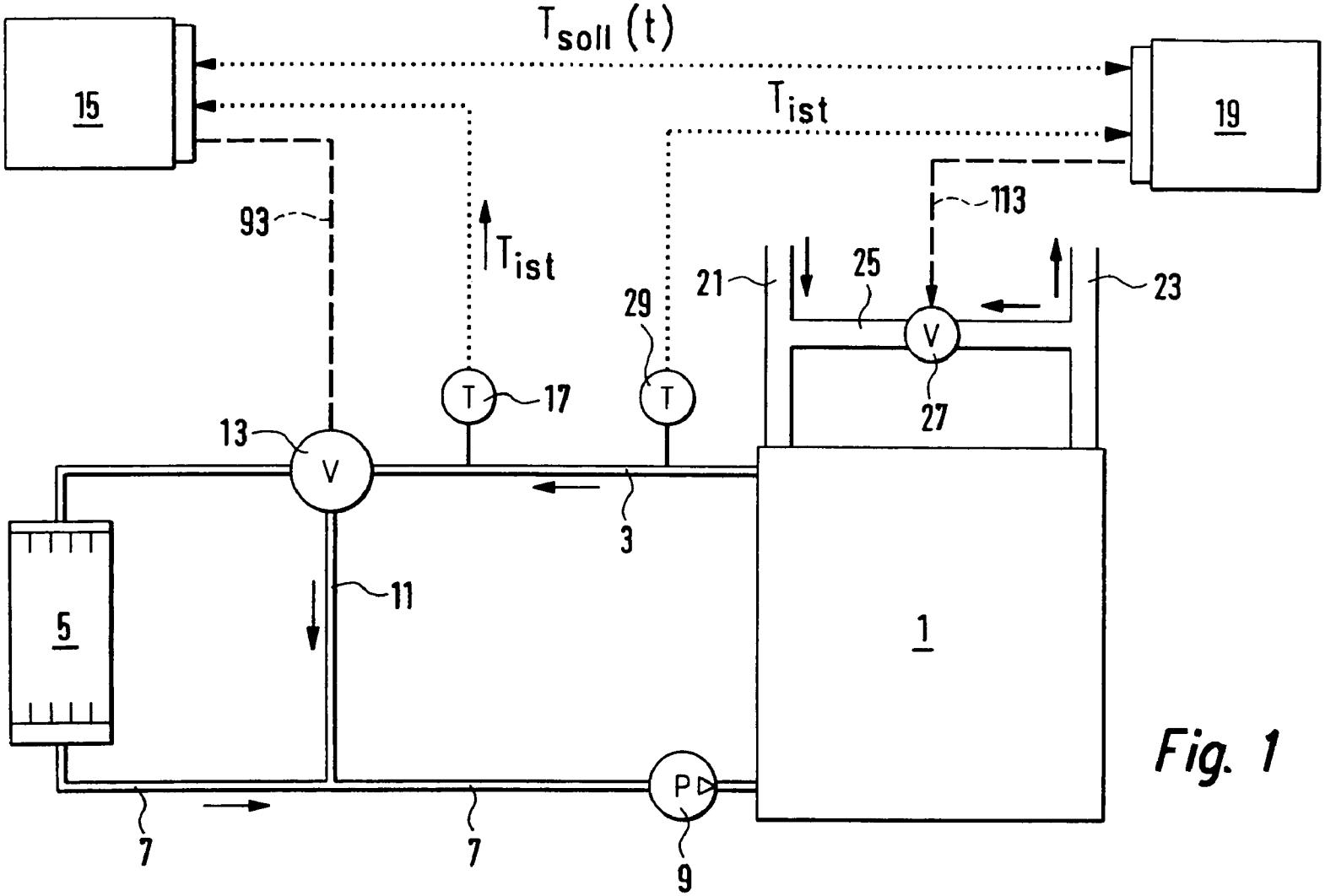
FIG. 1 shows a block diagram of an internal combustion engine operated by the method according to the present invention.

FIG. 1 shows as a block diagram an exemplary embodiment of an internal combustion engine 1 operated by the method according to the present invention. Internal combustion engine 1 is liquid-cooled. The coolant, in particular water containing additives, is supplied to a cooler 5 via a forward line 3. Subsequently the cooling water cooled in cooler 5 is returned to internal combustion engine 1 via a return line 7. A coolant pump 9 is mounted in return line 7 for recirculating the coolant. Coolant pump 9 may be driven either directly by the internal combustion engine or by an electrical drive.

To regulate the flow rate in the cooling circuit made up of forward line 3, cooler 5, return line 7, and coolant pump 9, a bypass line 11, via which the coolant may flow from forward line 3 to return line 7, bypassing cooler 5, is arranged between forward line 3 and return line 7. A valve 13 is provided to control the distribution of coolant between the flows through cooler 5 and bypass line 11. Valve 13 is activated by a first control unit 15 in such a manner that the internal combustion engine has a temperature $T_{setpoint}$. Control unit 15 activates valve 13 as a function of temperature $T_{actual}$ of forward line 3 measured by a first temperature sensor 17.

To ensure that the internal combustion engine temperature is maintained over a broader range of external conditions and operating states, coolant pump 9 may be provided with a flow controller.

FIG. 1 shows as an example the exhaust gas recycling of internal combustion engine 1 for a temperature-dependent function of internal combustion engine 1. The method according to the present invention is, however, not limited to controlling the exhaust gas recycling as a function of temperature $T_{setpoint}$ of internal combustion engine 1. In principle, any temperature-dependent function of the internal combustion engine may be controlled or regulated by the method according to the present invention.

Internal combustion engine 1 is controlled by a second control unit 19. Internal combustion engine 1 aspirates air via a suction line 21. The exhaust gas flows from the internal combustion engine into the environment via an exhaust line 23. An exhaust gas return line 25 is arranged between suction line 21 and exhaust line 23. A second valve 27, activated by second control unit 19, is mounted in exhaust gas return line 25. Depending on how second valve 27 is activated by second control unit 19, a greater or smaller portion of the exhaust gas may flow from exhaust line 23 into suction line 21 via exhaust gas return line 25.

When second valve 27 is closed, no exhaust gas flows from exhaust line 23 into suction line 21. Exhaust gas recycling is used to reduce emissions, in particular $NO_x$ emissions, of internal combustion engine 1.

Exhaust gas recycling is controlled by the second control unit as a function of a temperature $T_{actual}$ of forward line 3, determined by a second temperature sensor 29, which is a measure for temperature $T_{setpoint}$ of internal combustion engine 1. Temperature $T_{actual}$ of internal combustion engine 1 may also be determined by other temperature measurements.

All signal links between the different components of the internal combustion engine such as first valve 13, first temperature sensor 17, first control unit 15, second temperature sensor 29 and second control unit 19, as well as second valve 27, are shown by dashed lines in FIG. 1. The signal link may be either analog, digital or via a data bus.

It is also possible to combine first temperature sensor 17 and second temperature sensor 29 and to transmit a uniform signal to first control unit 15 and second control unit 19. Furthermore, first control unit 15 and second control unit 19 may be combined into a single control unit.

In the internal combustion engine according to the present invention illustrated in FIG. 1, the exhaust gas recycling rate may be determined as a function of the temperature measured by second temperature sensor 29. The first control unit may determine a setpoint temperature $T_{setpoint}$ as a function of external and internal boundary conditions for operating the internal combustion engine; this setpoint temperature is also transmitted to second control unit 19. Second control unit 19 is then able to control the exhaust gas recycling rate as a function of variable setpoint temperature $T_{setpoint}$ and measured actual temperature $T_{actual}$ of the internal combustion engine. As a result, the regulation of the exhaust gas recycling rate as a function of setpoint temperature $T_{setpoint}$ of the internal combustion engine is further optimized, which has a positive effect on the efficiency and emission characteristics of internal combustion engine 1.

Figure 2:
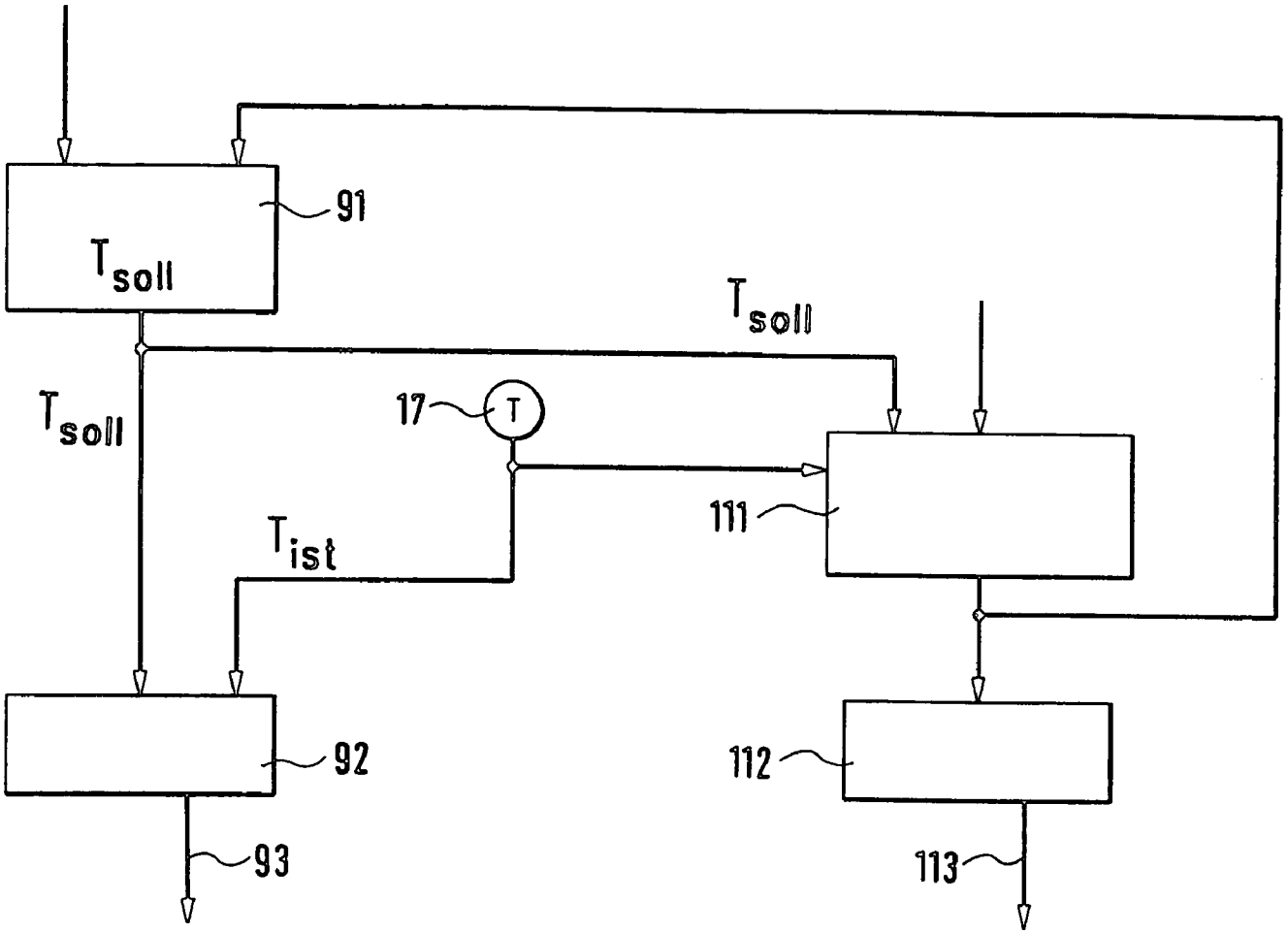
FIG. 2 shows an exemplary embodiment of a method according to the present invention for operating an internal combustion engine.

An exemplary embodiment of the method according to the present invention for operating the internal combustion engine is explained below with reference to FIG. 2, which shows a block diagram of this exemplary embodiment. Setpoint temperature $T_{setpoint}$ is determined in a determining block 91 as a function of external and internal boundary conditions, which are indicated in FIG. 2 by an arrow. External boundary conditions include temperature and humidity of the outside air, for example. Internal boundary conditions include the load on and the operating temperature of the internal combustion engine, for example. First block 91 provides setpoint temperature $T_{setpoint}$ of the internal combustion engine as an output quantity. This output quantity $T_{setpoint}$ is transmitted to a first component driver 92, for example. First component driver 92, which may also be integrated into an actuator, outputs an actuating signal 93 to the component driven by it, as a function of setpoint temperature $T_{setpoint}$ Actuating signal 93 may be the signal from first control unit 15, illustrated in FIG. 1, for activating thermostat valve 13, for example. First component driver 92 also takes into account temperature $T_{actual}$ of the internal combustion engine, which is determined by first temperature sensor 17.

Setpoint temperature $T_{setpoint}$ of the internal combustion engine, which is output by first block 91, is also input into a second block for determining one or more setpoint values of one or more performance parameters 111. In second block 111, a setpoint value of one or more performance parameters of a temperature-dependent function such as, for example, exhaust gas recycling of internal combustion engine 1, are determined as a function of setpoint temperature $T_{setpoint}$, actual temperature $T_{actual}$ and further input quantities, and a setpoint value of the performance parameter(s) is output.

This setpoint value of the performance parameters may be used in first block 91 for calculating the setpoint temperature, as indicated by an arrow in FIG. 2. The setpoint value of the performance parameter(s) is also used as an input quantity of a second component driver 112 for generating a second actuating signal 113.

Second actuating signal 113 may be used, for example, for controlling second valve 27 in exhaust gas return line 25.

As an alternative, any other temperature-dependent function of the internal combustion engine such as injection amount, ignition point, injection point, etc., may be activated using second actuating signal 113.

What is claimed is:

1. A method for controlling a cooling circuit of an internal combustion engine, comprising:

determining boundary conditions for operating the internal combustion engine;

determining a setpoint value of the internal combustion engine temperature as a function of the boundary conditions for operating the internal combustion engine;

regulating at least one of a thermostat valve of the cooling circuit and activation of a coolant pump as a function of the setpoint value of the internal combustion engine temperature; and regulating at least one further temperature-dependent function of the internal combustion engine as a function of the setpoint value of the internal combustion engine temperature.

2. The method of claim 1, wherein the boundary conditions for operating the internal combustion engine include at least one of an ambient temperature, a humidity of ambient air, a load on the internal combustion engine, a speed of the internal combustion engine, and a composition of a fuel/air mixture of the internal combustion.

3. The method of claim 1, wherein at least one of an exhaust-gas recycling rate, an injection amount, an injection point and an ignition point is regulated as a function of the setpoint value of the internal combustion engine temperature.

4. A computer-readable storage medium for storing a plurality of computer-executable program codes for controlling a cooling circuit of an internal combustion engine, the plurality of program codes performing, when executed on a computer, a method comprising:

determining boundary conditions for operating the internal combustion engine;

determining a setpoint value of the internal combustion engine temperature as a function of the boundary conditions for operating the internal combustion engine;

regulating at least one of a thermostat valve of the cooling circuit and activation of a coolant pump as a function of the setpoint value of the internal combustion engine temperature; and regulating at least one further temperature-dependent function of the internal combustion engine as a function of the setpoint value of the internal combustion engine temperature.

5. A control unit for controlling a cooling circuit of an internal combustion engine, comprising:

an arrangement for determining boundary conditions for operating the internal combustion engine;

an arrangement for determining a setpoint value of the internal combustion engine temperature as a function of the boundary conditions for operating the internal combustion engine; and an arrangement for regulating at least one of a thermostat valve of the cooling circuit and activation of a coolant pump as a function of the setpoint value of the internal combustion engine temperature, and regulating at least one further temperature-dependent function of the internal combustion engine as a function of the setpoint value of the internal combustion engine temperature.

* * * * *